US009896783B2

(12) United States Patent
Kia

(10) Patent No.: US 9,896,783 B2
(45) Date of Patent: Feb. 20, 2018

(54) MODIFICATION OF CONTINUOUS CARBON FIBERS DURING PRECURSOR FORMATION FOR COMPOSITES HAVING ENHANCED MOLDABILITY

(71) Applicant: GM Global Technology Operations LLC, Detroit, MI (US)

(72) Inventor: Hamid G. Kia, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/849,010

(22) Filed: Sep. 9, 2015

(65) Prior Publication Data

US 2017/0067185 A1 Mar. 9, 2017

(51) Int. Cl.

| | |
|---|---|
| ***D01F 9/22*** | (2006.01) |
| ***C08K 7/06*** | (2006.01) |
| ***D01F 6/54*** | (2006.01) |

(52) U.S. Cl.

CPC ..... *D01F 9/22* (2013.01); *C08K 7/06* (2013.01); *D01F 6/54* (2013.01); *D10B 2101/00* (2013.01); *D10B 2401/00* (2013.01)

(58) Field of Classification Search

CPC ..... D01F 9/00; D01F 9/22

See application file for complete search history.

(56) References Cited

U.S. PATENT DOCUMENTS 3,458,615 A 7/1969 Bragaw, Jr. et al.
5,024,818 A 6/1991 Tibbetts et al.
(Continued)

FOREIGN PATENT DOCUMENTS

CN 106521716 A 3/2017
CN 106521718 A 3/2017
(Continued)

OTHER PUBLICATIONS

Polyacrylonitrile (PAN) Carbon Fibers Industrial Capability Assessment, OUSD (AT&L) Industrial Policy, U.S Department of Defense (Oct. 2005); 23 pages.
(Continued)

*Primary Examiner* — Arrie L Reuther
(74) *Attorney, Agent, or Firm* — Harness, Dickey & Pierce, P.L.C.

(57) ABSTRACT

Methods of producing continuous carbon fibers for composites having enhanced moldability are provided. Discrete regions are introduced into a continuous precursor fiber comprising an acrylic polymer material, such as polyacrylonitrile (PAN), as the precursor fiber is formed. The precursors may be heterogeneous fibers having a second distinct material interspersed in discrete regions with the acrylic polymer material. Alternatively, the precursors may be heterogeneous fibers where laser is applied to the acrylic polymer material in discrete regions to cause localized molecular disruptions. After the continuous precursor fiber is heated for carbonization and/or graphitization, the precursor forms a continuous carbon fiber having a plurality of discrete weak regions. These relatively weak regions provide noncontiguous break points that reduce stiffness and improve moldability for carbon fiber polymeric composites, while retaining high strength levels. Carbon fiber polymeric composites incorporating continuous carbon fibers having the plurality of discrete noncontiguous weak regions are also provided.

19 Claims, 3 Drawing Sheets

(56) References Cited

U.S. PATENT DOCUMENTS

| | | | | |
|---|---|---|---|---|
| 5,582,912 | A | 12/1996 | McCullough, Jr. et al. | |
| 8,309,644 | B1 * | 11/2012 | Huang | D01F 11/14 423/447.1 |
| 2003/0100239 | A1 * | 5/2003 | Gaffney | C04B 35/83 442/354 |
| 2012/0213997 | A1 | 8/2012 | Wang et al. | |
| 2014/0264985 | A1 * | 9/2014 | Sutti | D01D 5/06 264/11 |
| 2017/0067186 | A1 | 3/2017 | Kia | |

FOREIGN PATENT DOCUMENTS

| | | | |
|---|---|---|---|
| DE | 102016116053 | A1 | 3/2017 |
| DE | 102016116662 | A1 | 3/2017 |
| EP | 2679619 | A1 | 1/2014 |
| GB | 2373793 | A | 10/2002 |

OTHER PUBLICATIONS

Technical Data Sheet, "Polyacrylonitrile (PAN): how is it made?", Toray Carbon Fibers Europe, http://www.toray-cfe.com/index.php/en/newsletter-v2/42-product/48-polyacrylonitrile-pan-how-is-it made, (downloaded on Aug. 14, 2015); 2 pages.

Park, Soon-Jin, et al., "Precursors and Manufacturing of Carbon Fibers," Springer Series in Materials Science, vol. 210 (Oct. 9, 2014); pp. 31-66.

Cytec Industries Inc.; Safety Data Sheet for VTM® 264 Prepreg; Aug. 5, 2013; 9 pages.

Cytec Industrial Materials; VTM® 264-1 & VTM® 264S-1; PDS1268_07.13_Issue1a; Jul. 17, 2013; 3 pages.

U.S. Appl. No. 15/274,280, filed Sep. 23, 2016, Kia et al.

Hamid G. Kia et al.; U.S. Appl. No. 15/211,814, filed Jul. 15, 2016 entitled "Carbon Fiber Pre-Pregs and Methods for Manufacturing Thereof"; 44 pages.

Hamid G. Kia et al.; U.S. Appl. No. 15/685,157, filed Aug. 24, 2017 entitled "Modification of Continuous Carbon Fibers During Precursor for Composites Having Enhanced Moldability"; 40 pages.

Hamid G. Kia et al.; U.S. Appl. No. 15/141,361, filed Apr. 28, 2016 entitled "Linear Expansion Reduction of Metal Component Assemblies Using Composites"; 41 pages.

* cited by examiner

MODIFICATION OF CONTINUOUS CARBON FIBERS DURING PRECURSOR FORMATION FOR COMPOSITES HAVING ENHANCED MOLDABILITY

FIELD

The present disclosure relates to methods of treating and making continuous carbon fiber precursors that are modified to create continuous carbon fibers that can improve moldability of high strength carbon fiber composites.

BACKGROUND

Carbon fibers are generally produced by carbonizing or graphitizing carbon fiber precursor material fibers. Conventional carbon fiber precursors may be formed from polyacrylonitrile (PAN), petroleum pitch, or rayon precursors, by way of example. Carbon fibers and graphite fibers are made and heat-treated at different temperatures and thus each has different carbon content. Typically a carbon fiber is fiber that has at least about 90% by weight carbon.

Carbon fibers are used as a light-weight reinforcement phase to make high-strength light-weight polymeric composite materials. The carbon fibers may be continuous filaments that may be thousands of micrometers (μm) or millimeters (mm) in length. A group of continuous carbon fibers are often categorized as a bundle of continuous carbon fiber filaments. Carbon fiber "tow" is usually designated as a number of filaments in thousands (designated by K after the respective tow number). Alternatively, carbon fiber bundles may be chopped or milled and thus form short segments of carbon fibers (filaments or bundles) typically having a mean fiber length between 50 μm and 50 mm (about 1.97 inches). While composites incorporating carbon fibers are all light-weight and high-strength, composites incorporating continuous carbon fiber filaments have especially high strength as compared to composites incorporating chopped or milled carbon fibers. By way of non-limiting example, a representative unidirectional continuous carbon fiber filament when incorporated into a composite has an ultrahigh ultimate tensile strength of about 1,500 to 2,000 MPa, while chopped carbon fibers have an ultimate tensile strength of about 200 MPa to 500 MPa.

While the ultrahigh strengths are highly desirable in certain applications, one technical challenge in using continuous carbon fibers in composites is the lack of flowability and formability, because composite pre-pregs incorporating continuous carbon fibers can be too stiff having high resistance to flow. Such inflexibility and rigidity translates to poor moldability, making it difficult to form three-dimensional shapes from composites having continuous carbon fibers. It would be desirable to form continuous carbon fiber composites having greater flexibility, higher flowability, and thus greater moldability with the capability of readily forming complex and three-dimensionally shaped components with ultrahigh-strengths.

SUMMARY

This section provides a general summary of the disclosure, and is not a comprehensive disclosure of its full scope or all of its features.

In various aspects, the present disclosure provides methods of producing a continuous carbon fiber for use in composites having enhanced moldability. The method may comprise incorporating a plurality of discrete regions into a continuous precursor fiber comprising an acrylic polymer material. After the continuous precursor fiber is heated for carbonization and graphitization, the continuous precursor fiber forms a continuous carbon fiber having a plurality of discrete weak regions corresponding to the plurality of discrete regions.

In other aspects, the present disclosure provides a method of producing a bundle continuous carbon fibers for use in composites having enhanced moldability. The method comprises incorporating a plurality of discrete regions into a plurality of continuous precursor fibers comprising a polyacrylonitrile material. The plurality of continuous precursor fibers forms the bundle of continuous carbon fiber. After carbonization and graphitization of the plurality of continuous precursor fibers, a plurality of discrete weak regions are formed in each continuous carbon fiber of the bundle corresponding to the plurality of discrete regions.

In yet other aspects, the present disclosure provides a carbon fiber composite having enhanced moldability. The carbon fiber composite comprises a polymeric matrix incorporating one or more continuous carbon fibers having a length of greater than or equal to about 2 inches. The one or more continuous carbon fibers comprise a plurality of discrete weak regions. In certain aspects, the plurality of weak regions has an ultimate tensile strength that is at least 50% less than the ultimate tensile strength of a remainder of the continuous carbon fiber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
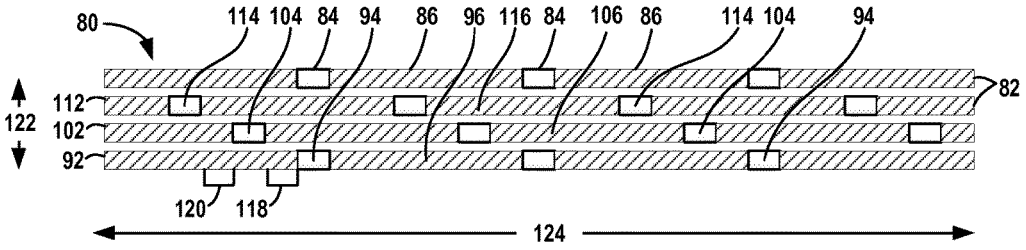

FIG. 3 is a schematic of a bundle of a plurality of continuous carbon fiber filaments prepared in accordance with certain aspects of the present disclosure. Each respective continuous carbon fiber filament has a plurality of discrete, noncontiguous, weak regions interspersed therein. The discrete weak regions are staggered and offset as compared to weak regions in the adjacent carbon fiber filaments.

Figure 4:
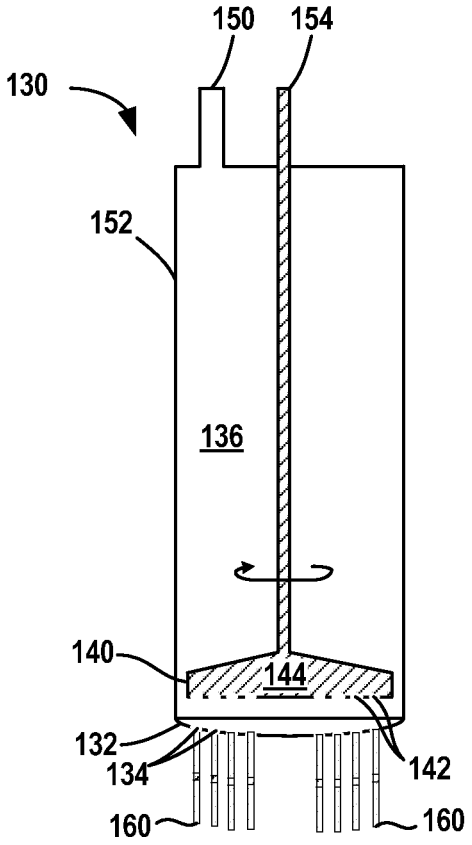

FIG. 4 is a system for co-spinning an acrylic polymer material with a second distinct polymer material to form a continuous carbon fiber precursor having a plurality of discrete regions corresponding to the second distinct polymer material.

Figure 5:
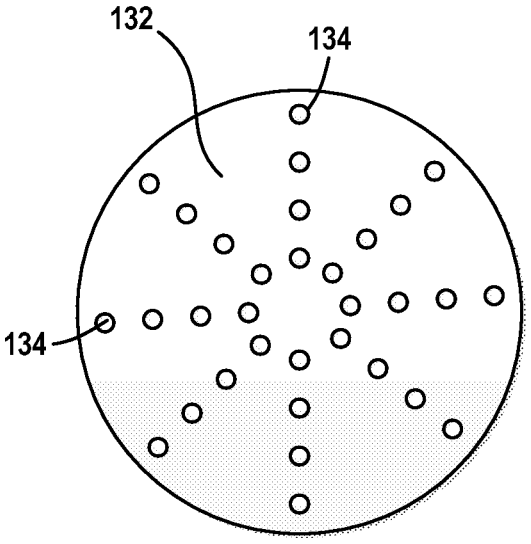

FIG. 5 shows a plan view of a pan spinneret for use in the system of FIG. 4.

Figure 6:
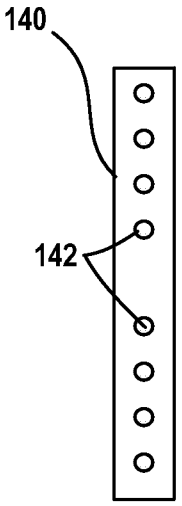

FIG. 6 shows a plan view of an internal spinneret for use in the system of FIG. 4 for introducing the second distinct material into streams of the acrylic polymer material.

Figure 7:
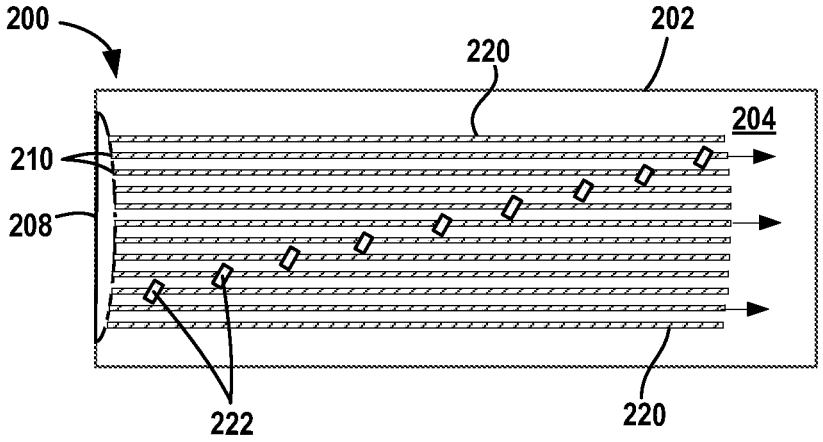

FIG. 7 shows a system for applying laser energy to continuous carbon fiber precursors to form a plurality of discrete regions having localized molecular disruptions that will serve as weak regions or break points when processed to be a carbon fiber in accordance with certain aspects of the present disclosure.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

In addition, disclosure of ranges includes disclosure of all values and further divided ranges within the entire range, including endpoints and sub-ranges given for the ranges.

Example embodiments will now be described more fully with reference to the accompanying drawings.

In various aspects, the present disclosure provides methods for improving moldability of composites having carbon fibers as a reinforcement phase. As noted above, while polymeric composites incorporating carbon fibers are high-strength and light-weight, they are typically difficult to make into complex three-dimensional shaped components. Carbon-fiber reinforced polymeric composites (CFRP) comprise a resin that is cured and/or solidified to form a polymeric matrix having a plurality of carbon fibers distributed therein as a reinforcement phase. CFRPs are often created from a pre-preg, where the carbon fibers are impregnated with uncured or partially cured resin. A component or part can be formed by using the pre-preg to be laid-up on a mandrel or mold, where it is then consolidated and cured to form the final component. In various aspects, the present disclosure pertains to use of continuous carbon fibers, which in certain aspects have a length of greater than or equal to about 2 inches, as compared to chopped or milled carbon fibers. In certain aspects, a continuous carbon fiber has a length of greater than or equal to about 2 inches, optionally greater than or equal to about 3 inches, greater than or equal to about 4 inches, optionally greater than or equal to about 5 inches, optionally greater than or equal to about 6 inches, optionally greater than or equal to about 7 inches, optionally greater than or equal to about 8 inches, optionally greater than or equal to about 9 inches, optionally greater than or equal to about 10 inches, optionally greater than or equal to about 11 inches, and in certain variations, optionally greater than or equal to about 12 inches (or 1 foot). Continuous carbon fiber polymeric composites have very high strengths and high stiffness (with high elastic modulus levels). However, without further manipulation, such continuous carbon fiber polymeric composites are not readily made into contoured or complex three-dimensionally shaped parts.

Two techniques are currently used to form complex shaped parts from continuous carbon fiber composites, but both suffer from certain drawbacks. The first technique incorporates continuous carbon fibers into a composite sheet having continuous unidirectional carbon fibers, but then divides the larger composite sheet into multiple smaller pieces (either as a pre-preg or just before application to form the component). The smaller cut pieces are then assembled so that the edges of adjacent pieces overlap in a manual layup process to create a larger structure. The smaller pieces thus have hundreds of thousands of continuous carbon fiber filaments (e.g., cut bundles) that terminate on the same cut line(s). While the smaller pieces can be laid up to create more complex shapes and contours, this technique has the disadvantage of reducing strength of the part because the unidirectional carbon fiber filaments all end along the same cut line. Even though the cut pieces overlap, there remain various loci or regions for stress propagation and fracture throughout the composite along the cut lines that reduces overall strength.

Alternatively, in another technique, the carbon fiber bundles may be chopped or milled into shorter fiber segments, typically with a maximum length of less than about 2 inches. Each bundle may have approximately 50,000 filaments (e.g., 50K tow), by way of example. Typically the chopped fibers are distributed in a single orientation homogenously within the composite as an anisotropic reinforcement phase. However, the short chopped fibers are discontinuous and provide open regions between distinct fibers for stress and crack propagation through the resin/polymeric matrix. While still providing high strengths, chopped carbon fiber composites typically have lower strengths than continuous carbon fiber composites, often an order of magnitude less.

In accordance with the present disclosure, composites comprising continuous carbon fibers are provided that retain high strength levels, but have improved moldability and reduced stiffness as compared to conventional continuous carbon fiber composites. In certain aspects, the method involves introducing localized molecular structural disruptions to a carbon fiber precursor at the filament level to intentionally create discrete weak regions that permit breaking points. In other aspects, a distinct material may be incorporated into the carbon fiber precursor along the filament to create discrete weak regions that are more easily broken. In either variation, the weak regions are formed at discrete and regular intervals along the length of each carbon fiber. A bundle of a plurality of such continuous carbon fiber filaments having the discrete weak regions is also contemplated. As will be discussed further herein, the discrete weak regions are preferably staggered with respect to adjacent continuous carbon fiber filaments.

Figure 1:
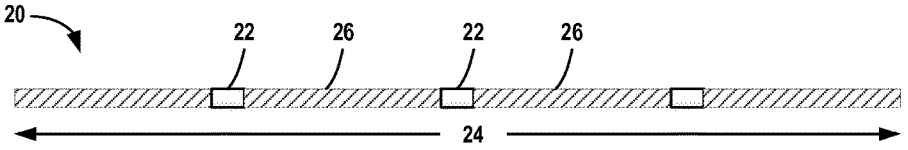
FIG. 1 is schematic of a continuous carbon fiber prepared in accordance with certain aspects of the present disclosure having a plurality of discrete relatively weak regions interspersed within the continuous carbon fiber that serve as break points when force or stress is applied to the continuous carbon fiber.

FIG. 1 shows an exemplary continuous carbon fiber 20 prepared in accordance with certain aspects of the present disclosure. In FIG. 1, the continuous carbon fiber 20 has a plurality of discrete weak regions 22 formed along a length 24 of the carbon fiber 20. Thus, the carbon fiber 20 includes a high strength body 26 having the plurality of weak regions 22 dispersed within the high strength regions of the body 26. In certain aspects, a weak region 22 is intended to mean a region that preferentially fractures or breaks when stress is applied as compared to the remainder of the body 26. In certain aspects, a weak region may be understood to have a strength (e.g., an ultimate tensile strength) that is at least about 50% less than a comparative ultimate tensile strength of a remainder of the continuous carbon fiber, optionally at least about 60%, optionally at least about 70%, optionally at least about 80%, and in certain aspects, optionally at least about 90% less than a comparative strength of the high strength regions of the remainder of the body of the carbon fiber. In one example, the continuous fiber is PAN-based and has a tensile strength of 5,000 MPa, whereas the weak region is lignin-based and has a tensile strength of 100 MPa. The weak region comprising lignin had about 98% less strength than the strong PAN-based region. In the past, when forming conventional continuous carbon fibers, it has been a goal to avoid introducing impurities or materials that might lead to any weaker regions to ensure that the carbon fibers are of uniformly high strength along the length of the carbon fiber. However, as will be described in greater detail below, introduction of these weak domains or regions in accordance with certain aspects of the present disclosure enables formation of carbon-fiber polymeric composites having high strength and low resistivity to flow, thus being more malleable and moldable.

Figure 2:
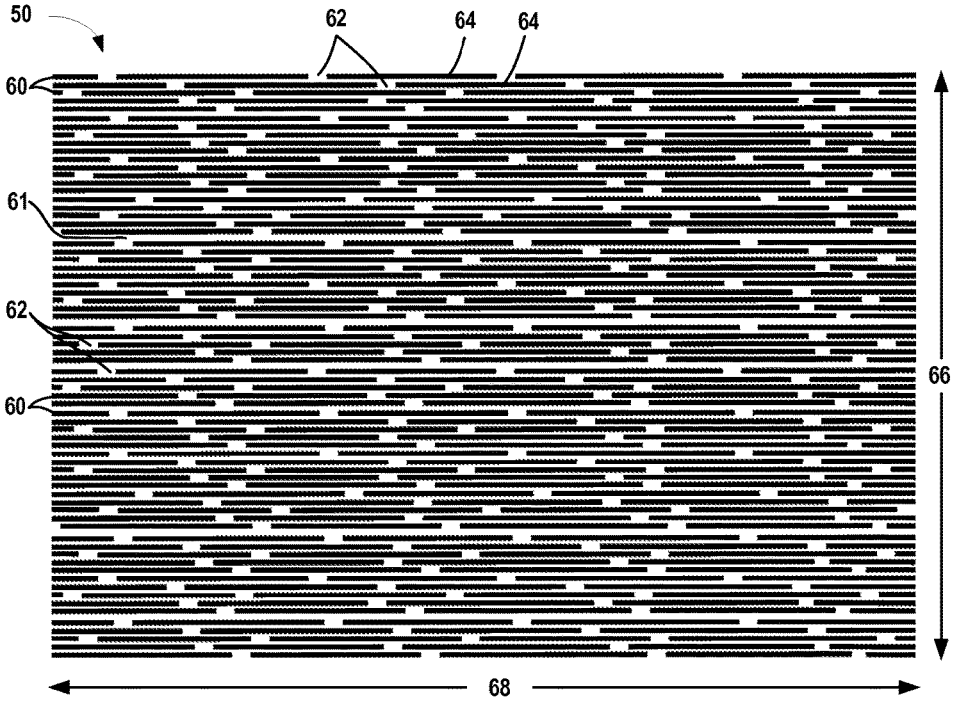
FIG. 2 is a schematic of a polymeric composite having a plurality of continuous carbon fiber filaments prepared in accordance with certain aspects of the present disclosure. Each respective carbon fiber filament has a plurality of discrete, noncontiguous, relatively weak regions or break points interspersed therein.

In FIG. 2, a carbon-fiber reinforced polymeric composite 50 prepared in accordance with certain aspects of the present disclosure is provided. The composite 50 has a plurality of continuous carbon fibers 60 and a polymeric matrix 61 distributed within and around the carbon fibers 60. The continuous carbon fibers 60 have a plurality of weak regions 62 distributed at regular intervals along each continuous carbon fiber 60. The plurality of weak regions 62 is staggered throughout the continuous carbon fibers 60 across a width 66 of the composite 50. Thus, the locations of the weak regions 62 differ along a length 68 of each continuous carbon fiber 60 with respect to adjacent carbon fibers 60. In this manner, the continuous carbon fibers 60 are capable of breaking at the weak regions 62 when bent, folded, or otherwise stressed, while not permitting stress and fracture propagation across the width 66 or length 68 of the composite 50. This maintains the strength of the composite 50 to near the strength levels provided by conventional continuous carbon fibers, but also provides lower stiffness and greater flexibility (with a lower resistance to flow).

In certain aspects, a plurality of continuous carbon fibers (e.g., a bundle of carbon fiber filaments) is contemplated by the present disclosure where each has a plurality of discrete weak regions. A first continuous carbon fiber has a first plurality of discrete weak regions and a second continuous carbon fiber adjacent to the first continuous carbon fiber has a second plurality of discrete weak regions. The first plurality of discrete weak regions is staggered with respect to the second plurality of discrete weak regions when the first continuous carbon fiber and the second continuous carbon fiber are aligned lengthwise.

FIG. 3 further exemplifies this concept, showing a detailed section of a partial view of a bundle 80 having a plurality of continuous carbon filaments or fibers 82. Each carbon fiber includes a plurality of discrete weak regions 84 formed along a body 86 of each fiber 82. A first carbon fiber 92 has a plurality of first discrete weak regions 94 interspersed within a body 96 having relatively higher strength. Each discrete weak region 94 is disposed along the body at regular intervals (e.g., having the same distance between respective weak regions 94). A second carbon fiber 102 is adjacent to the first carbon fiber 92. The second carbon fiber 102 has a plurality of second discrete weak regions 104 interspersed along a length of a body 106 at regular intervals. A third carbon fiber 112 is adjacent to the second carbon fiber 102. The third carbon fiber 112 has a plurality of third discrete weak regions 114 interspersed along a length of a body 116 at regular intervals. As can be seen, the plurality of first discrete weak regions 94 is offset from the second discrete weak regions 104 in the adjacent carbon fiber by a first distance 118. The plurality of second discrete weak regions 104 are likewise offset from the third discrete weak regions 114 in the adjacent third carbon fiber 112 by a second distance 120. In this manner, the plurality of first discrete weak regions 94, the plurality of second discrete weak regions 104, and the plurality of the third discrete weak regions 114 are staggered and offset with respect to both a width 122 and a length 124 of the bundle 80.

As such, while there are break points intentionally introduced into the carbon fibers 82 of the bundles, the weak regions are noncontiguous and dispersed throughout the high strength body 86 of each fiber. This design provides a greater ability to conform and be molded, while minimizing fracture and crack propagation, thus retaining the ultrahigh strengths associated with continuous carbon fibers. It should be noted that the plurality of weak regions may be spaced at shorter or longer distances from one another and may be spaced differently in distinct continuous carbon fiber/filaments of the bundle. Further, in alternative variations, the spacing between the weak regions may not be uniform between different regions and in certain aspects, may be randomly spaced. Notably, the longer the distance between the weak regions of the continuous carbon fiber, the higher the stiffness and strength of the composite formed with such the continuous carbon fibers. Where greater moldability and flexibility is required for the composite, the distance between the weak regions of the continuous carbon fiber may be shorter. This provides a greater number of break points (higher breakpoint density) within the continuous carbon fibers that will provide a composite with less resistance to flow, but with some diminished strength as well.

In certain aspects, each respective weak region is spaced apart from an adjacent weak region in the continuous carbon fiber by a distance of greater than or equal to about 0.1 inches to less than or equal to about 12 inches. In certain other aspects, a suitable range is greater than or equal to about 3 inches to less than or equal to about 6 inches.

In certain aspects, each respective weak region formed in the continuous carbon fiber provides a weak point capable of breaking, so a length of the weak region in the fiber is of less importance than the length between weak regions. However, in certain variations, a weak region may have a length of less than or equal to about 0.01 inches. In certain aspects, each weak region has a length of greater than or equal to about 0.10 inches to less than or equal to about 1.0 inch.

In certain aspects, the present disclosure contemplates a method of producing a continuous carbon fiber for use in composites having enhanced moldability. By way of background, a typical process for forming a carbon fiber includes first forming a carbon fiber precursor. The present disclosure pertains to forming a polymer based carbon fiber precursor that is transformed into a carbon fiber filament. Thus, one or more monomers are polymerized to form a polymer material. In certain variations, the polymer material comprises an acrylic polymer material. In certain aspects, the polymer material is formed from an acrylonitrile monomer and thus may be a polyacrylonitrile (PAN) polymer. In conventional carbon fiber precursor formation, one of more comonomers may be polymerized with the acrylonitrile monomer. The acrylic polymer material may a copolymer formed from an acrylonitrile monomer and a second monomer selected from the group consisting of: acrylic acid, itaconic acid, methacrylic acid, vinyl esters, such as methyl acrylate, ethyl acrylate, butyl acrylate, methyl methacrylate, vinyl acetate, and the like, vinyl amides, such as acrylamide, diacetone acrylamide, and the like, vinyl halides, such as allyl chloride, vinyl bromide, vinyl chloride, and the like, salts of vinyl compounds, such as quaternary ammonium salt of aminoethyl-2-mehtylpropeneoate, salts of sulfonic acids, such as sodium vinyl sulfonate, sodium p-styrene sulfonate, and the like, and combinations thereof. The most frequently used comonomers include itaconic acid, methacrylic acid, acrylic acid, and/or acrylamide polymerized with acrylonitrile.

After the polymerization, the acrylic polymer material may be combined with one or more carriers or solvents and then spun, for example, by melt or solution spinning, to form a plurality of continuous precursor fiber or filaments. The spinning process for acrylic PAN-based polymer precursors may be performed using traditional manufacturing techniques that are well known. The spinning process may include forming the precursor fibers in a spinning bath by ejecting the polymer material from a nozzle or a spinneret. The precursor fibers may then be conveyed to a second washing bath to wash the fibers from solvents and then the precursor fibers may pass through a drawing bath. The fibers may be stretched in such a drawing bath. The precursor fibers may then be dried. The carbon fiber precursor may be stretched to enable molecular alignment. The carbon fiber precursor may be wound on a creel for transport to a manufacturing facility for forming carbon fibers from the precursor fibers.

Prior to heat treating to begin the process of forming the carbon fiber, the precursor may be spread flat to form a tow band for a warp sheet. The precursor fiber may be subjected to an initial thermal stabilization (e.g., oxidation) process to obtain high quality carbon fibers. Such an initial thermal stabilization step is typically conducted by heating the precursor fibers at a controlled relatively low-temperature, for example, 200-300° C. in air to convert to a form that can be further heat-treated without either melting or fusion of the fibers. The linear PAN-based polymer precursor is typically at least partially converted to cyclic structures during this initial thermal stabilization step.

Thus, the stretched carbon fiber precursor may then be passed through an oxidation oven, during which, oxygen from the air combines with the carbon fiber precursor to form cross-linked polymer chains. The temperature and airflow in the oxidation oven is modified to supplement the composition of the carbon fiber precursor.

Next, the thermally stabilized fibers may be subjected to one or more heating steps that perform carbonization and graphitization. These steps are typically conducted in an oven or furnace with an inert atmosphere. While temperatures may vary, carbonization is typically performed at temperatures of at least 1,500° C.-1,600° C. An additional heat treatment step may also be conducted for graphitization. Graphitization typically occurs by heating the precursor fiber to a temperature in a range of greater than or to about 1,600° C.-3,000° C. Graphitization provides a high modulus in the carbon fiber formed. Thus, a two-step heating process may be conducted to form the carbon fiber, first a relatively low temperature carbonization process and then followed by a high-temperature graphitization process, depending on the final carbon fiber properties that are required.

Therefore, after passing through the oxidation oven for thermal stabilization, the carbon fiber precursor may be passed through one or more carbonization ovens or furnaces. Stretching continues as the carbon fiber precursor passes through the carbonization oven(s). Within each carbonization oven is an inert (e.g., oxygen-free) atmosphere. The temperature of the carbonization oven(s) progressively increases causing non-carbon molecules to particulate in the absence of oxygen. The particulate is then exhausted from the oven. The number of carbonization ovens through which the carbon fiber precursor is passed may depend on the grade of carbon fiber being manufactured. The carbon fiber may then enter an optional graphitization furnace for additional heat treatment. After the carbon fiber has been heated, it may be surface heated, sized, and spooled for later processing and use (e.g., incorporation into pre-preg or composite materials).

In certain aspects, the present disclosure thus provides methods of producing a continuous carbon fiber for use in composites having enhanced moldability. The method comprises incorporating a plurality of discrete regions into a continuous precursor fiber comprising an acrylic polymer material. The discrete regions are predetermined regions or domains that will become the weak regions within the carbon fiber eventually formed. Thus, the continuous precursor fiber is processed to form a continuous carbon fiber having a plurality of discrete weak regions corresponding to the plurality of discrete regions after it is heated for carbonization and graphitization.

In certain aspects, the incorporating of the plurality of discrete weak regions further comprises forming a stream of an acrylic polymer material and intermittently introducing a second distinct polymeric material into the stream to form a heterogeneous precursor fiber. The plurality of discrete regions correspond to and forms the plurality of discrete weak regions after the heterogeneous precursor fiber is heated (e.g., via thermal stabilization, carbonization, and/or graphitization processes) to form the carbon fiber.

Incorporating the plurality of discrete regions when forming the precursor fiber may be accomplished by co-spinning an acrylic polymer material (as described above, a conventional acrylic polymer material that may include any of the copolymers discussed above) and a second distinct polymeric material together. A stream of the primary acrylic polymer may thus be intermittently interrupted by jetting the second distinct polymeric material into the stream to create the plurality of discrete regions within the precursor fiber.

In certain variations, a spinning apparatus 130 may be used to accomplish such a process, as shown in FIGS. 4-6. A pan spinneret 132 in FIG. 5 has a plurality of apertures 134 formed for ejecting the main acrylic polymer material 136. Notably, many more apertures 134 may be created the pan spinneret 132, but a simplified version is shown for purposes of illustration. In FIG. 6, an internal dispensing spinneret 140 has a plurality of apertures 142. The internal dispensing spinneret 140 is used to dispense the second distinct material 144. Thus, the plurality of apertures 142 in the internal dispensing spinneret 140 may match the number and placement of the apertures 134 across a diameter of the pan spinneret 132.

As best shown in FIG. 4, the main acrylic polymer material 136 is introduced under pressure (e.g., via pumping) via a first conduit 150 into a main chamber 152. The main chamber 152 ends in the pan spinneret 132. The second distinct material 144 is introduced inside the main chamber 152 via a second conduit 154 that terminates in the internal dispensing spinneret 140. The second conduit 154 and the internal dispensing spinneret 140 are capable of rotation within the main chamber 152. As the internal dispensing spinneret 140 rotates, it selectively dispenses the second distinct material 144 over certain select apertures 134 of the pan spinneret 132. In this manner, the second distinct material 144 is intermittently introduced into a plurality of streams 160 to form fiber precursors by co-spinning. Thus, the streams 160 can be continuously formed with discrete regions defined by the second distinct material 144 formed in different areas and streams 160 as the internal dispensing spinneret nozzle 140 rotates within the pan spinneret 132.

The second distinct polymeric material is distinct from the acrylic polymer material. It may be selected to be a material that has a lower strength than the acrylic polymer material after being processed and heated to form the carbon fiber. In certain variations, the second distinct polymeric material is selected from the group consisting of: lignin, polyethylene, polystyrene, polymers comprising fillers having an average particle size of less than about 1 μm ("submicron" sized particles), and combinations thereof. Notably, introduction of the submicron sized particles can introduce weakness into the polymer as compared to the acrylic polymer material. In certain variations, the second distinct material comprises lignin. The domains of the second distinct polymeric material thus form the discrete regions within the precursor fiber that eventually are processed to form the discrete weak regions within the carbon fiber.

In other variations, the present disclosure provides methods of producing a continuous carbon fiber for use in composites having enhanced moldability. The method comprises incorporating a plurality of discrete regions into a continuous precursor fiber comprising an acrylic polymer material. The incorporating of the plurality of discrete regions into the continuous precursor fiber comprises spinning the acrylic polymer material in a solvent and applying laser energy to the acrylic polymer material in the plurality of discrete regions to prematurely volatilize the solvent. Other sources of energy similar to lasers may also be employed in alternative variations. Premature refers to the beginning of the solvent loss process at the plurality of discrete noncontiguous target regions at which the laser energy is directed as compared to initiation of solvent loss in the areas where the laser energy is not applied. As a non-limiting example, the direct laser energy applied may cause a rate of solvent loss to accelerate within the plurality of discrete noncontiguous target regions by greater than or equal to about 20%, optionally greater than or equal to about 30%, optionally greater than or equal to about 40%, and in certain variations, optionally greater than or equal to about 50% as compared to a rate of solvent loss in the regions not having laser energy applied.

Thus, the method includes directing laser energy at a plurality of discrete noncontiguous target regions. Heterogeneous regions are formed as a result of discrete noncontiguous localized molecular structural disruptions at the filament level of the carbon fiber precursor. The plurality of discrete regions has a different molecular organization than the remainder of the continuous precursor fiber, because the laser energy initiates premature volatilization of the solvent(s). Application of laser energy and thus localized heat truncates the molecular organization process (e.g., crystallization) and results in localized molecular structural disruption that creates weaker regions than those regions that are permitted to dry in a slower manner where conventional solvent removal rates permit molecular organization and alignment to fully occur.

Such a process can occur in a bath 200 shown in FIG. 7. A polymeric feedstock, for example, polyacrylonitrile (PAN) can be processed by coming into contact with a liquid comprising a solvent. As the polymeric feedstock loses the solvent the polymeric feedstock stretches. Thus, controlling a rate at which the solvent is lost from the precursor impacts the properties and ultimately the carbon fiber. A container 202 holds a liquid 204, such as water. A pan spinneret 208 is disposed within the container 202. An acrylic polymer material is ejected from orifices or apertures 210 in the pan spinneret 208 into the liquid 204. A plurality of streams 220 are created as the acrylic polymer material exits the pan spinneret 208 and enters the liquid 204. Laser energy may be applied to discrete hit points or regions 222 of the streams 220. The laser energy may be applied by conventional laser sources and directed from above or below the bath 200. As can be seen in FIG. 7, discrete regions 222 are staggered and spaced lengthwise and across the spinneret diameter from one another. The laser energy can be applied periodically to generate discrete, noncontiguous spaced apart regions within each stream 220 corresponding to the discrete regions 222 that will be further processed and dried to form the weak regions in the continuous precursor fiber. As will be appreciated by those of skill in the art, the regions of the streams where the laser energy may be applied may vary in configuration, spacing, and placement on the streams.

In various aspects, the present disclosure contemplates the method comprising introducing a plurality of discrete noncontiguous target regions into a carbon fiber precursor and ultimately into the carbon fiber formed. The heterogeneity may be created by localized molecular disruptions or by introducing a distinct material into the precursor fiber. This technique enhances the moldability of carbon fibers and allows the carbon fibers to be molded to follow the contours of a surface. This improves the surface quality of unpainted composite panels by avoiding fiber distortion around curvatures. In this manner, an improved carbon fiber composite is provided having little or no loss of mechanical properties, the benefits of which can be achieved with negligible additional manufacturing costs.

In certain aspects, the present disclosure contemplates a method of manufacturing or producing a bundle continuous carbon fibers for use in composites having enhanced moldability. The method comprises incorporating a plurality of discrete regions into a plurality of continuous precursor fibers comprising an acrylic polymer material comprising polyacrylonitrile. The plurality of continuous precursor fibers forms the bundle of continuous carbon fiber. The plurality of continuous precursor fibers is heated optionally for thermal stabilization and then for carbonization and graphitization. After carbonization and graphitization, a plurality of discrete weak regions are formed in each continuous carbon fiber of the bundle corresponding to the plurality of discrete regions that were formed in the precursor fibers.

In other aspects, the present disclosure provides a carbon fiber composite having enhanced moldability. The carbon fiber composite includes a polymeric matrix incorporating one or more continuous carbon fibers. In certain aspects, the continuous carbon fibers have a length of greater than or equal to about 2 inches. The one or more continuous carbon fibers comprise a plurality of discrete weak regions. The plurality of weak regions has a strength (e.g., an ultimate tensile strength) that is at least 50% less the strength of a remainder of the body of the continuous carbon fiber. In certain aspects, as discussed above, the weak region may have a strength that is at least about 60% less than a comparative strength of a remainder of the continuous carbon fiber, optionally at least about 80%, optionally at least about 90%, and in certain aspects, optionally at least about 95% less than a comparative strength of the high strength regions of the remainder of the body of the carbon fiber.

In certain aspects, the present disclosure provides a moldable carbon fiber composite pre-preg incorporating the continuous carbon fibers having one or more weak regions and with a 50% mold coverage that can flow and fill the mold cavity under less than 7 MPa compression molding to produce a 1.5 mm panel.

In other aspects, a moldable carbon fiber composite incorporating the continuous carbon fibers having one or more weak regions provided by the present disclosure still has an ultrahigh strength, for example, an ultimate tensile strength of greater than or equal to about 500 MPa, optionally greater than or equal to about 1,000 MPa, optionally greater than or equal to about 1,500 MPa, optionally greater than or equal to about 1,750 MPa, and in certain aspects, optionally greater than or equal to about 2,000 MPa.

The moldable carbon fiber composites are particularly suitable for use in components of an automobile or other vehicles (e.g., motorcycles, boats), but may also be used in a variety of other industries and applications, including aerospace components, industrial equipment and machinery, farm equipment, heavy machinery, by way of non-limiting example. For example, the carbon fiber composites having improved moldability according to the present disclosure may be used to form automotive structural components having contoured or complex three-dimensional shapes. Non-limiting examples include hoods, pillars, such as hinge pillars, panels, including structural panels, door panels, and door components, interior floors, floor pans, roofs, exterior surfaces, underbody shields, wheels, storage areas, including glove boxes, console boxes, trunks, trunk floors, truck beds, lamp pockets and other components, shock tower cap, control arms and other suspension, crush cans, bumpers, structural rails and frames, cross car beams, undercarriage or drive train components, and the like.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of producing a continuous carbon fiber for use in composites having enhanced moldability, the method comprising:

incorporating a plurality of discrete regions into a continuous heterogeneous precursor fiber comprising a polymer material by co-spinning a first polymeric and a second distinct polymeric material together to form a stream of a first polymeric material having a second distinct polymeric material intermittently introduced into the stream to form the continuous heterogeneous precursor fiber, wherein after the continuous heterogeneous precursor fiber is heated for carbonization and graphitization, the continuous heterogeneous precursor fiber forms a continuous heterogeneous carbon fiber having a plurality of discrete weak regions corresponding to the plurality of discrete regions.

2. The method of claim 1, wherein the first polymeric material is an acrylic polymer material.

3. The method of claim 2, wherein the second distinct polymeric material is selected from the group consisting of: lignin, polyethylene, polystyrene, polymers comprising submicron filler particles, and combinations thereof.

4. The method of claim 1, wherein the first polymeric material is an acrylic copolymer formed from an acrylonitrile monomer and a second monomer selected from the group consisting of: acrylic acid, itaconic acid, methacrylic acid, vinyl esters, vinyl amides, vinyl halides, salts of vinyl compounds, salts of sulfonic acids, and combinations thereof.

5. The method of claim 1, wherein the plurality of weak regions has an ultimate tensile strength that is at least 50% less than an ultimate tensile strength of a remainder of the continuous heterogeneous carbon fiber.

6. The method of claim 1, wherein each respective discrete weak region of the plurality of weak regions has a length of less than or equal to about 2 inches.

7. The method of claim 1, wherein each respective region of the plurality of weak regions is spaced apart from an adjacent weak region in the continuous heterogeneous carbon fiber by a distance of greater than or equal to about 0.1 inches to less than or equal to about 12 inches.

8. The method of claim 1, wherein the continuous heterogeneous carbon fiber formed is a plurality of continuous heterogeneous carbon fibers each having an average length of greater than or equal to about 2 inches.

9. A method of producing a continuous carbon fiber for use in composites having enhanced moldability, the method comprising:

incorporating a plurality of discrete regions into a continuous precursor fiber comprising a polymer material that is an acrylic polymer material by forming a stream of the acrylic polymer material and intermittently introducing a second distinct polymeric material into the stream to form a heterogeneous precursor fiber, wherein the intermittently introducing comprises co-spinning the acrylic polymer material and the second distinct polymeric material in a system comprising a pan spinneret and an internal dispersing spinneret so that the second distinct polymeric material is intermittently introduced into the stream of the acrylic polymer exiting the pan spinneret by rotating the internal dispersing spinneret during the co-spinning, wherein after the heterogeneous precursor fiber is heated for carbonization and graphitization, the heterogeneous precursor fiber forms a continuous carbon fiber having a plurality of discrete weak regions corresponding to the plurality of discrete regions.

10. The method of claim 9, wherein the second distinct polymeric material is selected from the group consisting of: lignin, polyethylene, polystyrene, polymers comprising submicron filler particles, and combinations thereof.

11. The method of claim 9, wherein the polymer material is an acrylic copolymer formed from an acrylonitrile monomer and a second monomer selected from the group consisting of: acrylic acid, itaconic acid, methacrylic acid, vinyl esters, vinyl amides, vinyl halides, salts of vinyl compounds, salts of sulfonic acids, and combinations thereof.

12. The method of claim 9, wherein the plurality of weak regions has an ultimate tensile strength that is at least 50% less than an ultimate tensile strength of a remainder of the continuous carbon fiber.

13. The method of claim 9, wherein each respective discrete weak region of the plurality of weak regions has a length of less than or equal to about 2 inches.

14. The method of claim 9, wherein the continuous carbon fiber formed is a plurality of continuous carbon fibers each having an average length of greater than or equal to about 2 inches and wherein each respective region of the plurality of weak regions is spaced apart from an adjacent weak region in the continuous carbon fiber by a distance of greater than or equal to about 0.1 inches to less than or equal to about 12 inches.

15. A method of producing a continuous carbon fiber for use in composites having enhanced moldability, the method comprising:

incorporating a plurality of discrete regions into a continuous precursor fiber comprising a polymer material, wherein the incorporating of the plurality of discrete regions into the continuous precursor fiber further comprises:

spinning a feedstock comprising the polymer material and a solvent; and applying laser energy in the plurality of discrete regions of streams of the feedstock to accelerate volatilization of the solvent, wherein the plurality of discrete regions has a different molecular organization than the remainder of the continuous precursor fiber formed after solvent has been removed, wherein after the continuous precursor fiber is heated for carbonization and graphitization, the continuous precursor fiber forms a continuous carbon fiber having a plurality of discrete weak regions corresponding to the plurality of discrete regions.

16. The method of claim 15, wherein the polymer material is an acrylic copolymer formed from an acrylonitrile monomer and a second monomer selected from the group consisting of: acrylic acid, itaconic acid, methacrylic acid, vinyl esters, vinyl amides, vinyl halides, salts of vinyl compounds, salts of sulfonic acids, and combinations thereof.

17. The method of claim 15, wherein the plurality of weak regions has an ultimate tensile strength that is at least 50% less than an ultimate tensile strength of a remainder of the continuous carbon fiber.

18. The method of claim 15, wherein each respective discrete weak region of the plurality of weak regions has a length of less than or equal to about 2 inches.

19. The method of claim 15, wherein the continuous carbon fiber formed is a plurality of continuous carbon fibers each having an average length of greater than or equal to about 2 inches and wherein each respective region of the plurality of weak regions is spaced apart from an adjacent weak region in the continuous carbon fiber by a distance of greater than or equal to about 0.1 inches to less than or equal to about 12 inches.

* * * * *